United States Patent [19]

Ono et al.

[11] 4,251,695

[45] Feb. 17, 1981

[54] PICKUP CARTRIDGE HAVING MEANS FOR PRODUCING MAGNETIC FIELDS OF OPPOSITE DIRECTIONS FOR COIL PLATE

[75] Inventors: Tsuyoshi Ono, Yamato; Norio Shibeta, Sagamihara; Katsuhiko Oguri, Fujisawa; Masayoshi Uchida, Yokohama; Kazuhiro Sato, Sagamihara; Hidetoshi Sato, Yamato, all of Japan

[73] Assignee: Victor Company of Japan Ltd., Yokohama, Japan

[21] Appl. No.: 954,296

[22] Filed: Oct. 20, 1978

[30] Foreign Application Priority Data

Oct. 24, 1977 [JP] Japan ..... 52-126717
Nov. 9, 1977 [JP] Japan ..... 52-134380

[51] Int. Cl.[3] ..... H04R 9/16
[52] U.S. Cl. ..... 369/136; 369/147
[58] Field of Search ..... 179/100.41 D, 100.41 K, 179/100.41 Z; 274/37; 360/123

[56] References Cited

U.S. PATENT DOCUMENTS

| | | | |
|---|---|---|---|
| 2,034,872 | 3/1936 | Keller | 179/100.41 D |
| 3,139,490 | 6/1964 | Lyons | 179/100.41 D |
| 3,207,857 | 9/1965 | Pautat | 179/100.41 D |
| 3,360,616 | 12/1967 | Shiga et al. | 179/100.41 D |
| 3,618,124 | 11/1971 | Dreisbach | 179/100.41 D |
| 3,648,264 | 3/1972 | Gruczelak et al. | 360/123 |
| 3,679,843 | 7/1972 | Cho | 179/100.41 K |
| 3,903,594 | 9/1975 | Koneval | 179/100.41 D |
| 3,932,827 | 1/1976 | Buhrer | 365/2 X |
| 4,093,833 | 6/1978 | Tsukamoto | 179/100.41 D |
| 4,124,783 | 11/1978 | Nemoto | 179/100.41 D |

FOREIGN PATENT DOCUMENTS

| | | | |
|---|---|---|---|
| 75642 | 3/1953 | Denmark | 179/100.41 Z |
| 79385 | 6/1955 | Denmark | 179/100.41 Z |
| 292827 | 6/1916 | Fed. Rep. of Germany | 179/100.41 D |
| 1135675 | 8/1962 | Fed. Rep. of Germany | 179/100.41 K |
| 1447982 | 12/1968 | Fed. Rep. of Germany | 179/100.41 K |
| 928077 | 6/1963 | United Kingdom | 179/100.41 K |
| 939983 | 10/1963 | United Kingdom | 179/100.41 K |

*Primary Examiner*—Stuart M. Hecker
*Assistant Examiner*—Donald McElheny, Jr.
*Attorney, Agent, or Firm*—Haseltine, Lake & Waters

[57] ABSTRACT

A moving-coil type pickup cartridge comprises a vibration system including a stylus for tracing a sound groove of a record disc, at least one coil plate adapted to vibrate in response to vibration of the stylus of the vibration system, and an arrangement for producing magnetic fields with respect to the coil plate. The coil plate has at least one coil formed by thin film in a spirally-shaped pattern. The magnetic field producing arrangement has at least one permanent magnet for producing magnetic fields wherein are produced magnetic fluxes of mutually opposite directions respectively in regions of the coil resulting from substantially halving of the coil in the vibration direction thereof.

4 Claims, 22 Drawing Figures

PICKUP CARTRIDGE HAVING MEANS FOR PRODUCING MAGNETIC FIELDS OF OPPOSITE DIRECTIONS FOR COIL PLATE

BACKGROUND OF THE INVENTION

The present invention relates generally to pickup cartridges of the moving-coil type wherein a coil plate comprising an electrically insulating thin sheet or plate and coils of spiral pattern made of an electroconductive film and formed on a surface of the insulating thin plate is provided in a vibrating system. More particularly, the invention relates to a moving-coil type pickup cartridge adapted to produce a high output by effectively utilizing the entire surface of the above mentioned coil.

In general, among the moving-coil type stereo pickup cartridges known heretofore, there has been one having a vibration system of a construction wherein a square or cross-shaped core, around which a coil wire is wound, is fixed to the rear end of a cantilever. In another known pickup cartridge of this type, two armature links are provided on a cantilever and coils are provided by winding coil wire respectively around the ends of these links.

In each of these known pickup cartridges, however, the moving-coil assembly fixed to the cantilever, which comprises the coil winding and the core or the coil windings and the armature links, has a large mass. Therefore, the equivalent mass of the vibration system is large, whereby the characteristics particularly in the high-frequency range are poor, and signal pickup with good characteristics over a wide band cannot be achieved. If, in order to reduce the mass, the number of winding turns of the coils is decreased, the output will drop. Consequently, it has not been possible by means of moving-coil type pickup cartridge known heretofore to accomplish good signal pickup reproduction with high output, good signal to noise ratio, and, moreover, flat characteristics up to even a high-frequency range over a wide band.

Another difficulty encountered in the prior art has been that, since a magnetic material such as iron or permalloy has been used for the core or coil winding frame, the magnetostriction due to hysteresis and magnetic saturation is large. Still another difficulty has been that, since the coil assembly comprises coil wire wound around a winding frame, the thickness and volume of the coil structure are large. For this reason, the gap between the yoke and the pole piece in which the coil structure is interposed must be made large, whereby the magnetic conversion efficiency is poor. A further problem has been that the work of winding the coil wire around the winding frame has been laborious. Particularly in order to obtain a high value of the above mentioned magnetic conversion efficiency, it is necessary to reduce the thickness and volume of the coil structure thereby to decrease the above mentioned gap. For this purpose, a very fine wire (e.g., of a diameter of 10 microns) must be used for the coil wire, and this gives rise to difficulties in the coil winding work, risk of wire breakage, and lowering of work efficiency.

Furthermore, according to the concept of another known stereo pickup cartridge of moving-coil type, two coils formed by winding coil wire in the same plane in D-shape as a whole are mounted on a cantilever in a state wherein they are partly overlapping each other and in a position where they intersect the polar axis perpendicularly. In this pickup cartridge, however, since the mass of the coil is large, the equivalent mass of the vibration system is large, and particularly the characteristics at the higher frequencies are very poor, whereby the cartridge cannot be considered to be practical. There is also a suggestion that these coils may be formed by printed circuits, but, with the above described coil arrangement, reduction to practice is difficult in any case. A pickup cartridge which embodies the above concept has not yet been reduced to practice and placed on the market.

Accordingly, the inventors have previously proposed a novel pickup cartridge of moving-coil type in which the above described difficulties have been overcome, and which has been reduced to practice.

In this previously proposed pickup cartridge, a pair of coils are formed in the form of thin film and in a substantially hexagonal, vortex-shaped pattern on a thin glass substrate measuring, for example, 1 mm and 2 mm in length and breadth with a thickness of 50 μm. This coil plate, which is of very light weight, for example, of the order of 0.25 mg., is mounted on the cantilever of the pickup cartridge. In the forming of the above described coil patterns, a thin film of a metal material of high electroconductivity such as, for example, nickel is first formed on both surfaces of the thin insulative substrate by a process such as evaporation deposition in a vacuum. Then parts of the metal film thus deposited are removed by a process such as photo-etching to leave the metal film in the spirally wound pattern of the coils. To the casing of the pickup cartridge are fixed a pair of opposed yoke pieces having a gap therebetween in which the above mentioned coils are inserted and a permanent magnet for producing a magnetic field in the gap by way of these yokes. A feature of this pickup cartridge is that the mass of the coil plate is very small, whereby signal picking up can be carried out with good characteristics up to and through the higher frequencies.

In the above described previously proposed moving-coil type stereo pickup cartridge, a pair of yoke pieces form a magnetic field in a gap therebetween in which a coil plate is interposed. Each of the yoke pieces has two edge parts which are interconnected mutually at right angle and are at angles of 45°—45° with respect to the direction perpendicular to the record disc. However, since the yoke pieces have a shape such that they confront only approximately one half of the respective coils of the above mentioned coil plate, only one half of each coil contributes to the current inducing action and the other half does not as the coil plate vibrates together with the cantilever. Furthermore, leakage flux occurs from the edges of the yolk pieces. For this reason, in the above mentioned other half of each coil not confronting the corresponding yolk piece, there is induced a current of a direction such as to cancel the current induced in the above mentioned original magnetic flux by the leakage flux. For these reasons, there have been problems in the prior art such as low output level, occurrence of some distortion, and poor linearity.

SUMMARY OF THE INVENTION

Accordingly, it is a general object of the present invention to provide a novel and useful moving-coil type pickup cartridge in which the above described problems have been solved.

Another and specific object of the invention is to provide a moving-coil type pickup cartridge of an organization capable of effectively contributing to the current inducing action over substantially the entire surface of the coils. In accordance with the present invention, the other half of each coil, which heretofore did not contribute to current induction, also contributes to current induction, and furthermore, since there is no deleterious effect due to leakage flux, the power generation efficiency is good, whereby high output can be obtained. In addition, the output has no distortion, and the linearity is good.

Still another object of the invention is to provide a moving-coil type pickup cartridge wherein a laminated coil plate is used for the above mentioned coil plate, and an even higher output is obtained.

Other objects and further features of the invention will be apparent from the following detailed description when read in conjunction with the accompanying drawings.

DETAILED DESCRIPTION

Figure 1:
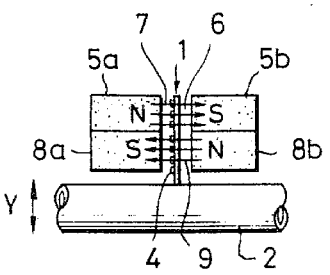
FIG. 1 is a side view of essential parts for a description of the principle of the moving-coil type pickup cartridge according to the invention.
Figure 2:
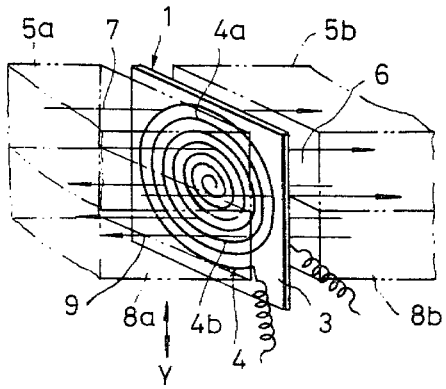
FIG. 2 is a schematic perspective view of the same essential parts.

The principle of the essential parts of the moving-coil type pickup cartridge according to the present invention will be first described with reference to FIGS. 1 and 2. One of these essential parts is a coil plate 1 mounted on a cantilever 2 and vibrating unitarily therewith when the cantilever 2 vibrates as a stylus (not shown) provided at the free tip thereof traces a groove in a record disc. The coil plate 1 comprises, essentially, an electrically insulative thin plate 3 and a spiral coil pattern 4 formed by an electroconductive thin film on the thin plate 3.

A first pair of permanent magnets 5*a* and 5*b* are disposed in mutually spaced-apart positions with respectively different magnetic poles thereof confronting each other with a gap 6 therebetween on opposite sides of the coil plate 1. In the illustrated example, the mutually confronting magnetic poles of the magnets 5*a* and 5*b* are respectively the N pole and the S pole, and, in the gap 6 therebetween, a magnetic flux 7 from the magnet 5*a* toward the magnet 5*b* is established. A second pair of permanent magnets 8*a* and 8*b* are disposed in spaced-apart positions with respectively different magnetic poles thereof confronting each other with the gap 6 therebetween on opposite sides of the coil plate 1. This second pair of magnets 8*a* and 8*b* are disposed immediately adjacent and in register with the first pair of magnets 5*a* and 5*b* and also with respectively different magnetic poles thereof adjacent each other as indicated in FIG. 1. In the illustrated example, the mutually confronting magnetic poles of the magnets 8*a* and 8*b* are respectively S and N poles, and a magnetic flux 9 from the magnet 8*b* toward the magnet 8*a* is established in the direction opposite that of the above mentioned magnetic flux 9.

The magnets 5*a* and 8*a* and the magnets 5*b* and 8*b* are disposed on opposite sides of the coil plate 1 at positions relative thereto such that the magnetic flux 7 passes through substantially the upper half 4*a* of the coil 4 (as viewed in FIGS. 1 and 2), and the magnetic flux 9 passes through substantially the lower half 4*b* of the coil 4.

Then, when the coil plate 1 undergoes vibratory displacement in the Y direction together with the cantilever 2, the upper half 4*a* of the coil 4 traverses across the magnetic flux 7, whereby a current is induced therein, and the lower-half coil 4*b* traverses across the magnetic flux 9, whereby a current is induced therein. In this case, the coil extending directions of the upper half coil 4*a* and the lower half coil 4*b* are opposite, but since the directions of the magnetic fluxes 7 and 9 are also mutually opposite, the currents induced respectively in the upper half coil 4*a* and the lower half coil 4*b* are added to each other. As a result, a large output current is obtained from the coil 4.

In this connection, the construction in the aforedescribed known pickup cartridge is such that the magnetic flux 7 is formed with respect to only the upper half coil 4*a*. For this reason, when the power generating efficiency of the known cartridge, in the case where it is assumed that there is no effect of leakage flux, is taken at 100 percent, the power generating efficiency of the cartridge of the present invention becomes twice relative thereto or 200 percent. In the known cartridge, however, the lower half coil is subject to the effect of leakage flux, and, for this reason, a part of the induced current is cancelled, whereby the actual power generating efficiency is of the order of 70 percent. In contrast to this, in the cartridge of the present invention, the lower half coil also contributes actively to power generation, and there is no effect of leakage flux, whereby the power generating efficiency of the cartridge of the invention is approximately three times that of the known cartridge. Moreover, there is no distortion in the output signal, and, further, the linearity is good.

Figure 3:
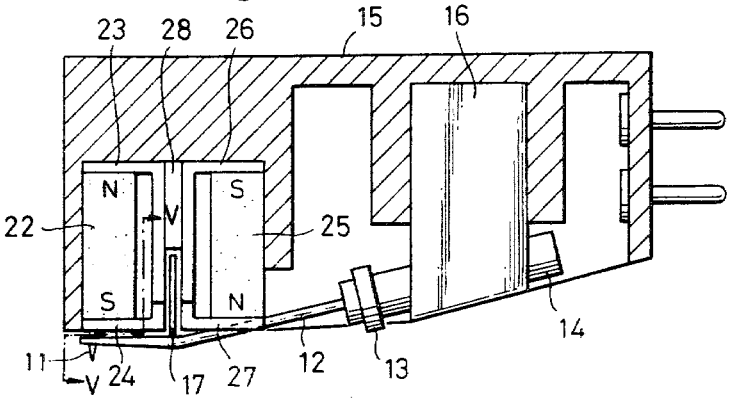
FIG. 3 is a side view, in longitudinal section, showing the essential construction of a first embodiment of the moving-coil type pickup cartridge according to the invention.

A first embodiment of the moving-coil type pickup cartridge of the present invention based on the above described principle will now be described with reference to FIGS. 3, 4, and 5. A cantilever 12 having a stylus 11 fixed to its free end is held at its rear end part by a holder 14 by way of a damper 13 interposed therebetween. The holder 14 is supported by a supporting block 16 fixed to a case 15. In a groove cut in the cantilever 12 at a position in the vicinity of its free end, a coil structure or coil plate 17 is so fixed that its plane is transverse to the axial direction of the cantilever 12.

Figure 4:
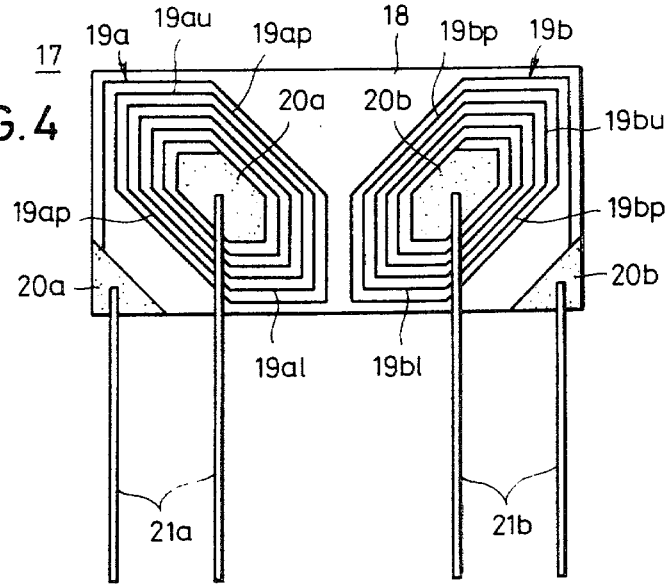
FIG. 4 is a front view of one example of a coil plate.

As shown in FIG. 4, the coil plate 17 is a structure comprising a thin glass substrate 18 of, for example, height and transverse dimensions of 1 mm. and 2 mm. and a thickness of 50 microns and a pair of coils 19*a* and 19*b* formed as thin films in a spirally wound pattern of approximately hexagonal shape on the glass substrate 18. The coils 19*a* and 19*b* have respectively parallel parts 19*ap* and 19*bp*. At the ends of the coils 19*a* and 19*b*, there are formed electroconductor parts 20*a* and 20*b* of widths greater than the widths of the thin film coil wires. Two lead wires 21*a* and two lead wires 21*b* are connected to and led out from these electroconductor parts 20*a* and 20*b*, respectively. The weight of the coil plate 17 is of very low value of the order of 0.25 mg., for example. Accordingly, this pickup cartridge of the invention is superior to the conventional cartridge in accomplishing good signal pickup and reproduction over a wide band up to a high-frequency range with flat characteristics.

A first pair of yokes 23 and 24 clamping at their rear ends a permanent magnet 22 of flat plate shape and a second pair of yokes 26 and 27 clamping at their rear ends a permanent magnet 25 of flat plate shape are accommodated in and fixed to the front part of the case 15. These yokes 23 and 24 and yokes 26 and 27 are so disposed that their vertical yoke faces 23*a* and 24*a* and vertical yoke faces 26*a* and 27*a* are respectively confronting each other and are spaced apart by a specific distance. A non-magnetic plate 28 is clamped between the yoke faces 23*a* and 26*a* of the yokes 23 and 26 at parts of the gap therebetween other than the lower end part. The yokes 23, 24, 26 and 27 are formed from a material of high permeability and high degree of saturated magnetic flux density.

Figure 5:
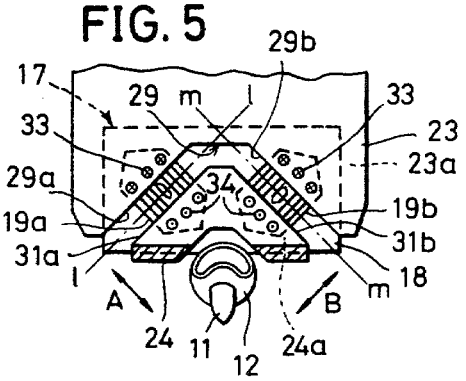
FIG. 5 is a sectional view taken along the line V—V in FIG. 3 as viewed in the arrow direction.
Figure 6:
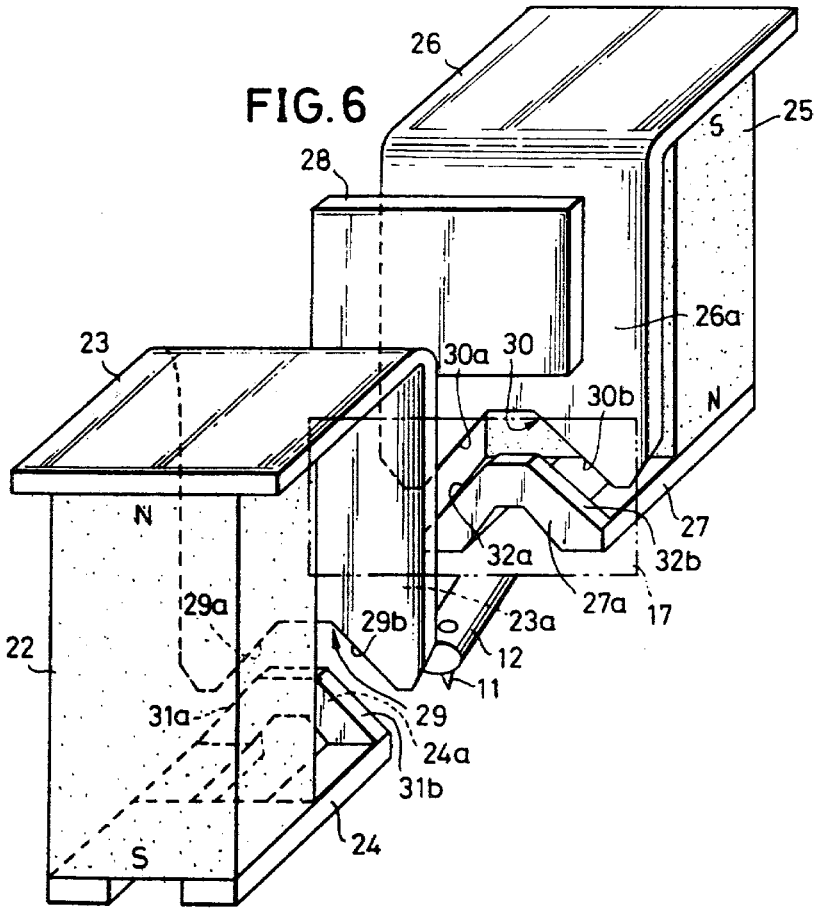
FIG. 6 is a greatly enlarged, exploded, perspective view of the essential parts of the pickup cartridge shown in FIG. 3.

At the lower end part of the vertical faces 23*a* and 26*a* of the yokes 23 and 26, as shown in FIG. 5, there are formed cutouts 29 and 30 of substantially inverted V-shape respectively having edges 29*a* and 29*b* and edges 30*a* and 30*b* respectively parallel to lines l—l and m—m extending in directions respectively perpendicular to arrow directions A and B, which are mutually perpendicular and are at angles of 45—45 degrees with a line vertical to a record disc. Accordingly, the regions of the yoke faces 23*a* and 26*a* in the vicinity of the lower end part thereof are confronting the upper half parts 19*au* and 19*bu* of the coils 19*a* and 19*b* of the coil plate 17.

The upper edges 31*a*, 31*b*, 32*a*, and 32*b* of the yoke faces 24*a* and 27*a* of the yokes 24 and 27 are formed to be spaced apart from and parallel to the above mentioned lower edges 29*a*, 29*b*, 30*a*, and 30*b* of the yoke faces 23*a* and 26*a*. Accordingly, the regions of the yoke faces 24*a* and 27*a* in the vicinity of the their upper ends are confronting the lower half parts 19*al* and 19*bl* of the coils 19*a* and 19*b* of the coil plate 17.

The magnets 22 and 25 respectively have magnetic poles at their upper and lower ends and are so disposed that the polarities of their upper and lower ends are mutually opposite. For example, in the illustrated example, the magnetic poles of the upper and lower ends of the magnet 22 are N and S poles, while the magnetic poles of the upper and lower ends of the magnet 25 are S and N poles. Accordingly, in the case of the present example, a magnetic flux 33 is produced between the yokes 23 and 26 from the region near the lower end part of the yoke face 23*a* toward the region near the lower end part of the yoke face 26*a*, while a magnetic flux 34, of opposite direction relative to the magnetic flux 33 is produced between the yokes 24 and 27 from the yoke face 27*a* toward the yoke face 24*a*. In FIG. 5, the reference symbols ⊗ indicate lines of magnetic flux receding from the viewer, that is, in the direction from the front surface of the paper toward the rear surface, and the reference symbols ⊙ indicate lines of flux from the rear surface of the paper toward the front surface.

When the coil plate 17 vibrates in the arrow direction A together with the cantilever 12, electric power is generated in the coil 19*a*, and when the coil plate 17 vibrates in the arrow direction B, electric power is generated in the coil 19*b*. Then, as is apparent from the principle described hereinbefore in conjunction with FIGS. 1 and 2, the currents generated by the upper half part 19*au* and the lower half part 19*al* of the coil 19*a* are added, while the currents generated by the upper half part 18*bu* and the lower half part 19*bl* of the coil 19*b* are added, whereby high output signals are respectively produced.

Figure 7A:
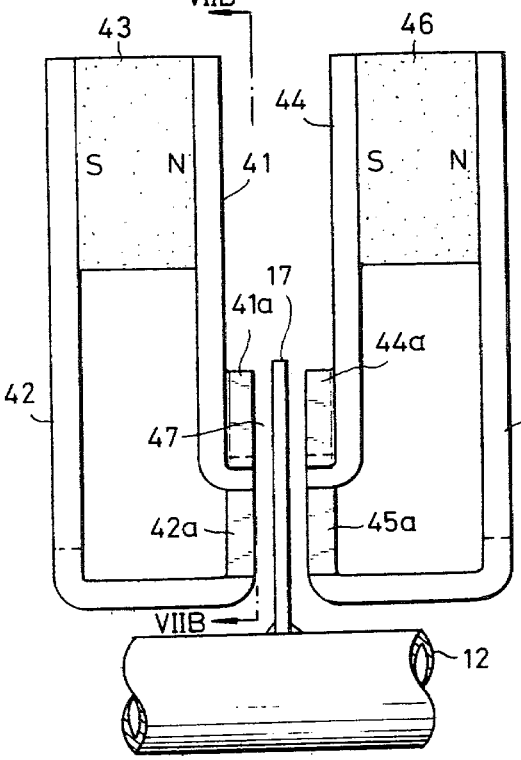
FIG. 7A is an enlarged side view showing the essential parts of a second embodiment of the moving-coil type pickup cartridge of the invention.
Figure 7B:
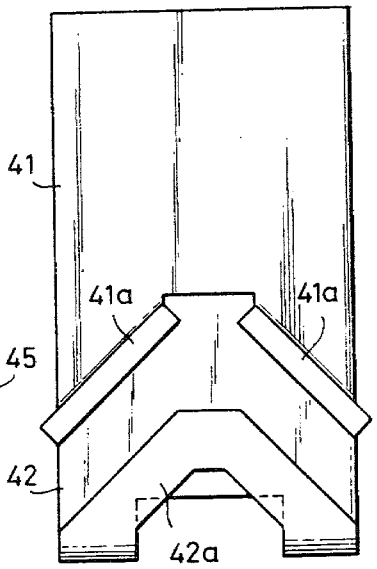
FIG. 7B is a sectional view taken along the line VIIB—VIIB in FIG. 7A as viewed in the arrow direction.

The essential parts of a second embodiment of the pickup cartridge according to the present invention are shown in FIGS. 7A and 7B. A first pair of yokes 41 and 42 clamp and hold at their rear ends a permanent magnet 43 magnetized in the thickness direction. The yoke 41 has bent parts 41*a* formed at the lower end thereof and projecting forward with mutual inclinations. The yoke 42 has a bent part 42*a* formed at the lower end thereof and having edges forming an inverted V-shape parallel to the bent parts 41*a*. A second pair of yokes 44 and 45 clamp and hold at their rear ends a permanent magnet 46 magnetized in the thickness direction. These yokes 44 and 45 have the same shapes as the yokes 41 and 42, respectively, and have respective bent parts 44*a* and 45*a* which are spaced apart from and confront the bent parts 41*a* and 42*a* with the coil plate 17 interposed in a gap 47 therebetween.

The magnet 46 is so disposed that its N and S poles contact the yokes 45 and 44 in the case where the N and S poles of the magnet 43 are contacting the yokes 41 and 42, for example. As a result, in the gap 47, a magnetic flux from the bent part 41*a* toward the bent part 44*a* is produced, and, at the same time, a magnetic flux is produced in the opposite direction from the bent part 45*a* toward the bent part 42*a*. Accordingly, the upper and lower half parts of the coils of the coil plate 17 respectively carry out effective power generating operation, and, moreover, the currents thus induced are added to produce a high output.

Figure 9:
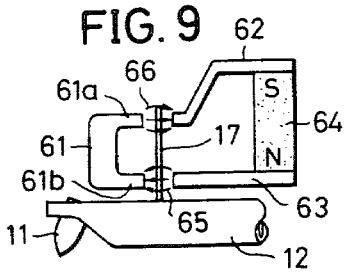
FIG. 9 is a side view of a fourth embodiment of the moving-coil type pickup cartridge of the invention.
Figure 8:
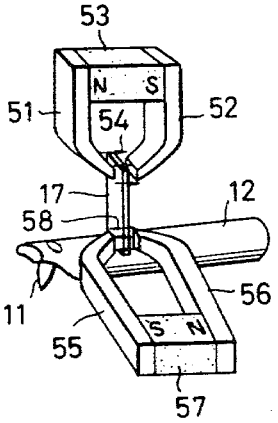
FIG. 8 is a perspective view of a third embodiment of the moving-coil type pickup cartridge of the invention.

The essential point is that the highly advantageous features of the pickup cartridge of the invention can be attained by forming magnetic fields of fluxes of opposite direction respectively with respect to the upper half parts and lower half parts of the coils, and a structural organization as schematically illustrated to indicate the principle in FIGS. 8 and 9 may be used.

In the embodiment of the invention as shown in FIG. 8, a first pair of yokes 51 and 52 clamp and hold at their rear ends a permanent magnet 53. The other ends of these yokes 51 and 52 confront from above the upper half part of the coil plate 17. The N and S poles of the magnet 53 are in contact with the yokes 51 and 52, and a magnetic flux 54 is produced from the yoke 51 toward the yoke 52 in the gap between the ends of the yokes 51 and 52. A second pair of yokes 55 and 56 clamp and hold at their rear ends a permanent magnet 57. The other ends of these yokes 55 and 56 confront from one side the lower half part of the coil plate 17. The N and S poles of the magnet 57 are in contact with the yokes 56 and 55, and a magnetic flux 58 is produced from the yoke 56 toward the yoke 55 in the gap between the ends of the yokes 55 and 56.

In the embodiment of the invention shown in FIG. 9, a yoke 61 having bent flanges 61*a* and 61*b* is so disposed that the outer edges of these bent flanges are respectively confronting and spaced apart from the upper and lower half parts of one side of the coil plate 17. A pair of yokes 62 and 63 are disposed with their ends spaced apart from and confronting the other side of the coil plate 17. A permanent magnet 64 is clamped and held by the other ends of these yokes 62 and 63. In the case where the N and S poles of the magnet 64 are in contact with the yokes 63 and 62, a magnetic flux 65 is produced from the yoke 63 toward the bent flange part 61*b* of the yoke 61, and, furthermore, a magnetic flux 66 is produced from the bent flange part 61*a* of the yoke toward the yoke 62.

Figure 10:
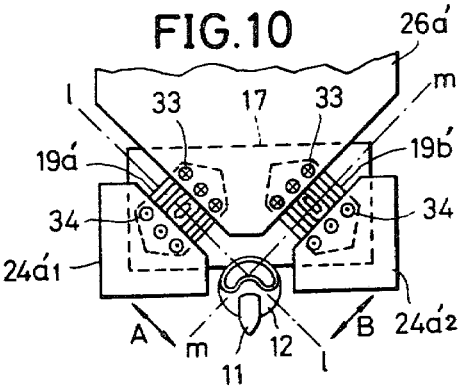
FIG. 10 is a front view of the essential parts of the moving-coil type pickup cartridge of the invention.

In the case where the coils 19*a* and 19*b* of the coil plate 17 illustrated in FIG. 4 are so disposed that their longitudinal axes are orientated in directions perpendicular to those shown in FIG. 4, the shapes of the yokes become as shown in FIG. 10. The extremity of the yoke 26*a*′ is formed with a V-shape, and the other yokes $24a'_1$ and $24a'_2$ have edges that are parallel to the edges of the yoke 26*a*′. The line l—l between the yokes 26*a*′ and $24a'_1$ and the line m—m between the yokes 26*a*′ and $24a'_2$ are respectively parallel to the arrow directions A and B. The yoke 26*a*′ confronts the upper half parts of the coils 19*a*′ and 19*b*′, while the yokes $24a'_1$ and $24a'_2$ respectively confront the lower half parts of the coils 19*a*′ and 19*b*′. By using an arrangement of magnets similar to that in the aforedescribed first embodiment of the invention, magnetic fluxes 33 and 34 of the same directions as in the first embodiment of the invention are formed.

While, in the above described embodiment of the invention, the coil plate 17 is mounted on the cantilever 12 in the vicinity of its free end, it may be mounted directly or by way of a supporting member on the cantilever 12 in the vicinity of its root part. Furthermore, while the above mentioned coil plate 17 is of a construction wherein the coils of two channels are provided on a single base plate, two coil plates each comprising one base plate and a coil for one channel provided on the one base plate may be used instead. In a further possible modification, two coil plates may be mounted in a wing-like state wherein their surfaces are parallel to the longitudinal direction of the cantilever and, at the same time, are at angles of 45 degrees relative to the vertical line. In each of these cases, of course, permanent magnets and/or yokes are provided to form magnetic fields with respect to the coils similarly as in the above described cases. Furthermore, the coil pattern is not limited to a hexagonal shape but may be any other pattern provided that it is of spirally winding form. The number of the permanent magnets is not limited to two but may be more than two.

While a high output current can be obtained by a pickup cartridge of the above described organization, a coil plate wherein a plurality of coil patterns are in laminated state may be used for the coil plate 17 in order to obtain an even higher output.

Figure 11:
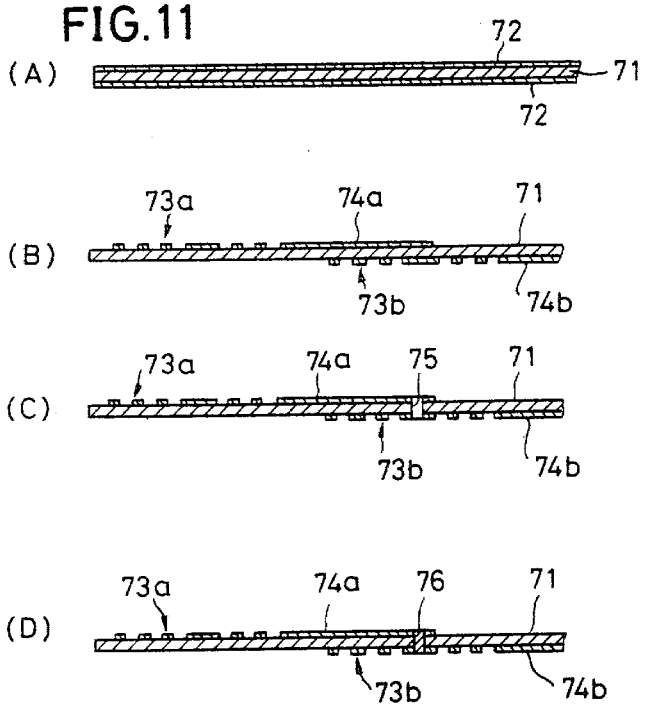
FIGS. 11(A), 11(B), 11(C), and 11(D) are sectional views respectively showing a sheet-form coil plate in progressive steps of one embodiment of a process of fabricating a laminated coil.

One example of a method of fabricating a laminated coil according to the present invention will now be described. For the sake of simplification of the description, the case of fabrication of a single coil by laminating a plurality of coil patterns will be considered. First, as indicated in FIG. 11(A), an electroconductive film 72 is deposited by evaporation deposition over both surfaces of a thin substrate or base plate 71 made of an electrically insulating material. Then, by photoetching the electroconductive film 72, coil patterns 73*a*, 73*b*, 73*c*, . . . and lead patterns 74*a*, 74*b*, 74*c*, . . . extending out respectively from the terminal parts of these coil patterns 73*a*, 73*b*, 73*c*, . . . are so formed on the base plate 71 that, when the resulting coil plate is folded along lines dividing it into areas of the size of the desired coil plate into a zig-zag folded stack wherein the two surfaces of the coil plate are alternately facing upward or downward, the coil patterns become spirals of the same direction, as shown in FIGS. 11(B) and 12.

As shown in FIG. 11(C), holes 75*a*, 75*b*, . . . are made through the base plate 71 commonly for the lead patterns 74*a*, 74*b*, . . . and the central parts of the coil patterns 73*b*, 73*c*, . . . . Thereafter, the holes 75*a*, 75*b*, . . . are filled with an electroconductive material 76, and the lead patterns 74*a*, 74*b*, . . . and the coil patterns 73*b*, 73*c*, . . . are electrically connected by way of the electroconductive material 76. As a result, the coil patterns 73*a*, 73*b*, 73*c*, . . . are electrically connected in series via the lead patterns 74*a*, 74*b*, . . . .

Figure 12:
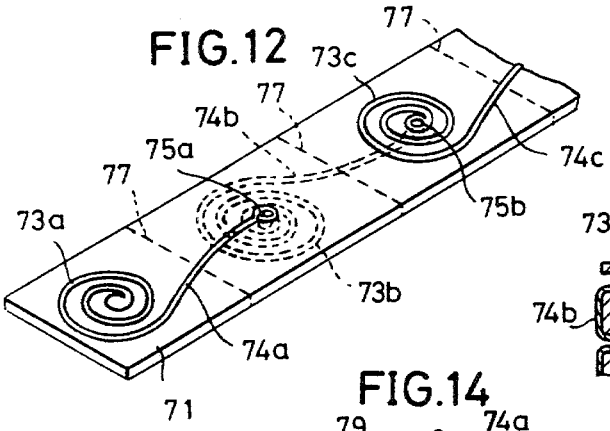
FIG. 12 is a perspective view of a sheet-form coil plate.
Figure 13:
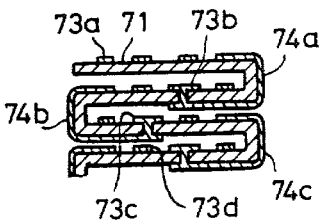
FIG. 13 is a sectional view showing the state of producing a laminated coil by folding a sheet-form coil plate.
Figure 14:
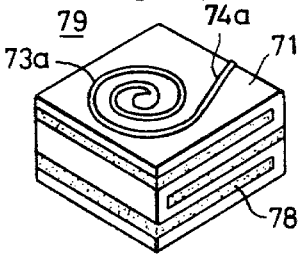
FIG. 14 is a perspective view of a laminated coil plate thus produced.

An electrically insulating material is applied as a coating by a method such as evaporation deposition on both surfaces of the sheet-form coil plate obtained in the above described manner, and then the coil plate is folded with alternate fold directions as indicated in FIG. 13 along lines of section 77 shown in FIG. 12 so that the coil patterns 73*a*, 73*b*, . . . are superimposed or piles up. Then, as indicated in FIG. 14, the mutually facing surfaces of the coil plate thus folded into a zig-zag form are mutually bonded and fixed by means of an adhesive 78, whereupon a laminated coil plate 79 is obtained. It is to be understood that in the figures of the drawings, distances in the thickness direction are expanded for convenience in illustration.

Figure 15A:
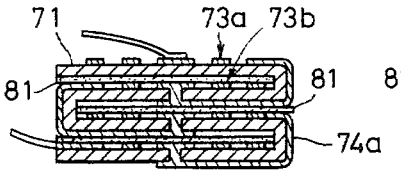
FIGS. 15A and 15B are sectional views respectively showing modifications of the laminated coil plate.
Figure 15B:
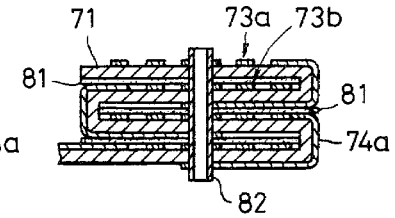

Instead of applying the electrically insulating material as a coating at the time of the above described folding process, a procedure wherein pieces of an electrically insulating sheet 81 are clamped between mutually facing surfaces of the folded coil plate as indicated in FIG. 15A may be carried out. Furthermore, as shown in FIG. 15B, a construction wherein a through-hole is made through the entire laminated coil plate in the folded state, and a hollow tube 82 is passed through this hole may be used. In this case, the tube 82 prevents the laminations in the folded and stacked state from becoming mutually displaced by slipping.

Figure 16A:
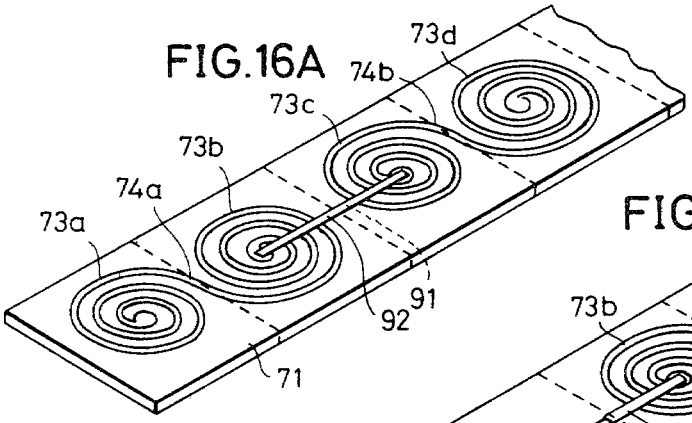
FIGS. 16A and 16B are respectively a perspective view and a sectional view of another embodiment of a sheet-form coil plate for producing a laminated coil plate of the invention.
Figure 16B:
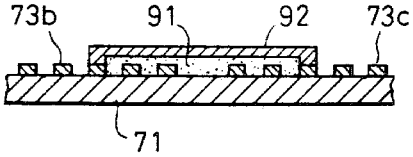

Another example of coil pattern arrangement on a sheet-form coil plate is illustrated in FIGS. 16A and 16B. In this embodiment of the invention, pairs of coil patterns 73*a* and 73*b*, coil patterns 73*c* and 73*d*, . . . are formed on only one side of the base plate 71 with mutually opposite winding, the paired coil patterns being connected respectively by lead patterns 74*a*, 74*b*, . . . . An electrically insulating layer 91 is formed to cover portions of the coil patterns between the central parts of the coil patterns 73*b* and 73*c*, and a lead pattern 92 is formed by evaporation deposition on this insulating layer 91 to electrically connect the central parts of the coil patterns 73*b* and 73*c*. Then, by folding the coil plate, after coating with an electrically insulating material or interposing pieces of an insulating sheet, into a zig-zag folded stack, a laminated coil plate is obtained. In the present embodiment of the invention, since the evaporation deposition is applied on only one surface of the base plate 71, the yield at the time of production is better than that in the aforedescribed known example.

Figure 17:
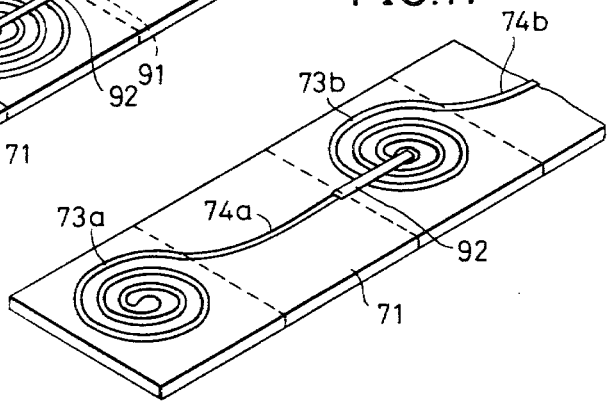
FIG. 17 and FIG. 18 are respectively perspective views of still other embodiments of the sheet-form coil plate according to the invention.

Furthermore, an arrangement as indicated in FIG. 17 may be used. Coil patterns 73*a*, 73*b*, . . . of the same winding directions are respectively formed on every other section of the base plate 71, and lead patterns 74*a*, 74*b*, . . . are formed in the empty sections on the same side of the base plate 71. Between one end of each lead pattern 74*a* and the central part of the corresponding coil pattern 73*b*, an electrically insulating layer is formed, and then a lead pattern 92 of an electroconductive layer is formed similarly as in the preceding embodiment of the invention.

Figure 18:
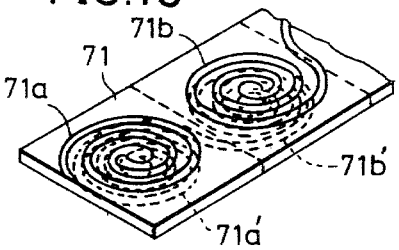

In addition to the forming of the various patterns on only one side of the base plate, these patterns may be formed on both surfaces of the base plate in each of the fold sections as shown in FIG. 18.

Figure 19:
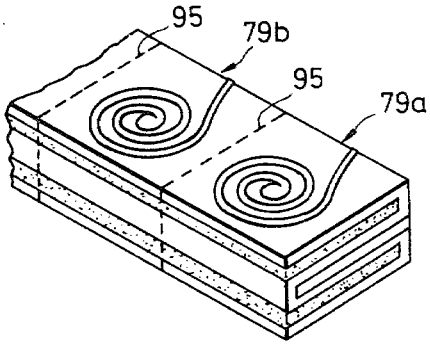
FIG. 19 is a perspective view of a further embodiment of the laminated coil plate.

Furthermore, by forming patterns of a plurality of rows on a base plate 71 of wide width, folding and stacking the base plate as indicated in FIG. 19, and cutting the base plate thus stacked along the section lines 95 of the rows, a large number of laminated coil plates 79*a*, 79*b*, . . . can be fabricated with high efficiency.

While, in each of the above described embodiments of the invention, one laminated coil plate is formed for use for one channel, a laminated coil plate for two-channel stereo use can be formed by forming the coil patterns in two rows as one set.

In each of the above described embodiments of the invention, sheet-form materials such as, for example, vinyl chloride resin sheet, aluminum foil subjected to an electrically insulating process, and polyimide resin sheet can be used for the insulating base plate 71.

Further, this invention is not limited to these embodiments but various variations and modifications may be made without departing from the scope of the invention.

What is claimed is:

1. A moving-coil type pickup cartridge comprising:

a vibration system including a stylus for tracing a sound groove of a record disc;

at least one coil plate having at least one coil formed thereon, said coil plate being fixed to the vibration system so as to vibrate in response to vibration of the stylus; and magnetic means including two pairs of yokes, a first pair of said yokes confronting each other with a gap therebetween in which the one half of the coil is interposed and producing a magnetic field in which a magnetic flux is directed in one direction through one region within said gap, a second pair of said yokes confronting each other with a gap therebetween in which the remaining half of the coil is interposed and producing a magnetic field in which a magnetic flux is directed in the direction opposite to said one direction through another region within said gap, said first and second pairs of yokes having respectively parallel edges extending in directions of 45—45 degrees with respect to a line vertical to the record disc.

2. A moving-coil type pickup cartridge comprising:

a vibration system including a stylus for tracing a sound groove of a record disc;

at least one coil plate having at least one coil formed thereon, said coil plate being fixed to the vibration system so as to vibrate in response to vibration of the stylus; and magnetic means comprising a first permanent magnet, first and second yoke pieces having front and rear ends and clamping at rear ends thereof the first permanent magnet, a second permanent magnet, and third and fourth yoke pieces having front and rear ends confronting the front ends of the first and second yoke pieces with a gap formed therebetween in which the coil is interposed and clamping at rear ends thereof the second permanent magnet, said first and third yoke pieces clamping a non-magnetic plate to form said gap, said magnetic means producing the magnetic fields of mutually opposite directions between the first and third yoke pieces and the second and fourth yoke pieces.

3. A moving-coil type pickup cartridge comprising:

a vibration system including a stylus for tracing a sound groove of a record disc;

at least one coil plate having at least one coil formed thereon, said coil plate being fixed to the vibration system so as to vibrate in response to vibration of the stylus; and magnetic means comprising: a single permanent magnet, a pair of yoke pieces clamping at rear ends thereof the permanent magnet, and an additional yoke piece with a pair of confronting parts confronting the pair of yoke pieces with a gap therebetween in which the coil is interposed, said magnetic means producing magnetic fields of mutually opposite directions between one of the pair of yoke pieces and one of the pair of confronting parts and between the other of the pair of yoke pieces and the other of the pair of confronting parts.

4. A moving-coil type pickup cartridge comprising:

a vibration system including a stylus for tracing a sound groove of a record disc;

at least one coil plate comprising a laminated coil plate of which thin insulating base plate formed with a plurality of coil patterns is bent and folded in such a manner that the coil patterns are piled up, said coil plate being fixed to the vibration system so as to vibrate in response to vibration of the stylus; and magnetic means including a gap in which the coil plate vibrates, said magnetic means producing magnetic fields, one of said magnetic fields being produced to pass in one direction through one half of the coil in the vibration direction thereof, the other of said magnetic fields being produced to pass in the opposite direction through the remaining half of the coil.

* * * * *